United States Patent [19]

Hutchinson et al.

[11] Patent Number: 4,757,902

[45] Date of Patent: Jul. 19, 1988

[54] CARTON AND BLANK FOR PACKAGING ICE CREAM AND THE LIKE

[75] Inventors: Jack E. Hutchinson, Rochester; Paul J. Donohie, Pittsford, both of N.Y.; Richard E. DePaul, Williamsburg, Va.; Frank G. Capauano; Robert J. McCormick, both of Rochester, N.Y.

[73] Assignee: Rolph-Clark-Stone Packaging Corporation, Newport News, Va.

[21] Appl. No.: 106,877

[22] Filed: Oct. 13, 1987

[51] Int. Cl.[4] ..... B65D 5/54

[52] U.S. Cl. ..... 206/626; 206/611; 206/624; 229/145; 229/905

[58] Field of Search ..... 206/608, 611, 624, 626, 206/631; 229/141, 145, 150, 152, 169, 180, 905

[56] References Cited

U.S. PATENT DOCUMENTS

| | | | |
|---|---|---|---|
| 3,144,980 | 8/1964 | Larson | 229/51 |
| 3,165,254 | 1/1965 | Moore | 229/51 |
| 3,197,114 | 7/1965 | Holmes | 229/51 |
| 3,206,915 | 9/1965 | Anderson | 53/374 |
| 3,219,257 | 11/1965 | Anderson | 206/611 |
| 3,281,055 | 10/1966 | Buttery | 229/51 |
| 3,315,870 | 4/1967 | Barnes | 206/624 |
| 3,353,740 | 11/1967 | Outwater | 229/51 |
| 3,758,023 | 9/1973 | Meyers | 206/611 |
| 3,833,165 | 9/1974 | Hoiles | 229/37 R |
| 4,046,313 | 9/1977 | Perry | 206/611 |
| 4,113,102 | 9/1978 | Mueller | 206/611 |
| 4,555,027 | 11/1985 | Froom | 206/626 |
| 4,669,614 | 6/1987 | Froom | 206/626 |
| 4,712,689 | 12/1987 | Froom | 206/626 |

*Primary Examiner*—Stephen Marcus
*Assistant Examiner*—Gary E. Elkins
*Attorney, Agent, or Firm*—Shlesinger Arkwright & Garvey

[57] ABSTRACT

A carton for packaging ice cream and the like comprising a receptacle including operably connected front, bottom and rear panels. A cover having a cover panel and a closure flap is hingedly connected to the receptacle for sealing the carton. The front, bottom, rear, and cover panels each have left and right end flaps operably connected to their left and right edges. The end flaps are dimensioned such that upon folding they form substantially sealed left and right carton ends. In the preferred embodiment, a breakaway tab is detachably formed in the cover panel end flap. The front surface of the breakaway tab is secured to the rear panel end flap so as to minimize any gaps between the end flaps forming the carton ends. Upon initial opening of the carton, the breakaway tab is severed from the cover panel end flap permitting the consumer to readily gain access to the contents of the carton.

32 Claims, 4 Drawing Sheets

CARTON AND BLANK FOR PACKAGING ICE CREAM AND THE LIKE

BACKGROUND OF THE INVENTION

There are at least two fundamental requirements for cartons used for packaging ice cream and the like. The carton must be esthetically pleasing to the consumer. Secondly, the seal of the carton must be such that it prevents liquids or semi-liquids from leaking from the ends thereof.

In an effort to enhance the overall appearance of ice cream cartons it has been known to print, on the exterior of the carton, scenes depicting enticing scoops of ice cream and the like. The premise being the more attractive and alluring the carton is the more likely the consumer is to purchase the ice cream. The body panels of the carton provide a substantially continuous surface which readily receives printing thereon. The ends of the carton, however, are formed generally from four end flaps extending from the body panel. In previously known ice cream cartons, the end flaps when folded in form a very irregular surface. Gaps or spaces exist between the various end flaps. These gaps and irregularities in the carton ends detract significantly from the overall appearance of the carton. More specifically the gaps make it very difficult to display a unified scene on the carton ends. Thus, valuable advertising space is lost or not utilized to its fullest potential.

The presently known process for packaging ice cream makes it essential that a carton have a sufficient seal to prevent semi-liquids or liquids from leaking therefrom. During the process of packaging ice cream, a carton is customarily erected wherein one of the carton ends is sealed and the other carton end is open. A filling instrument is positioned above the open end and dispenses ice cream in a semi-liquid or liquid state into the carton. The carton is then sealed and passed along a conveyor system through a chiller or refrigeration unit wherein the ice cream is solidified. The seal of the carton must be adequate to ensure against leakage from the time that the semi-liquid or liquid is dispensed into the carton until the time the ice cream solidifies. Previously known cartons contain gaps between the end flaps folded inwardly to form the carton ends. These gaps allow semi-liquids or liquids to leak from the carton and form residue on its exterior surface. The residue solidifies during the refrigeration process. These cartons must be disposed of because they project an image of damaged goods.

The present invention discloses an ice cream carton that eliminates the above disadvantages of previously known ice cream cartons.

OBJECTS AND SUMMARY OF THE INVENTION

It is a primary object of the present invention to provide and improved carton for packaging ice cream and the like.

Another of object of the present invention is to provide the ends of a carton with a breakaway tab for eliminating the gaps between the end flaps forming the carton ends.

A further object of the present invention is to provide a carton that can be readily resealed by the consumer upon initial opening thereof.

Still another object of the present invention is to provide a carton having a breakaway tab formed in an end flap such that the carton can be resealed after the tab has been severed from the respective end flap.

Yet another object of the present invention is to provide a carton that can be manufactured in multiples, from web or sheet stock, with minimum waste or scrap produced during the blanking operation and efficient nesting of one blank against another.

A further object of the present invention is to provide a carton including ends having a substantially continuous surface for displaying printed matter formed thereon.

Yet another object of the present invention is to provide a carton with an improved seal for preventing residue from forming on the outer surface thereof.

Another object of the present invention is to provide a carton blank that can be readily erected by mechanical means without residue forming on the outer surface of the carton.

A further object of the present invention is to provide a breakaway tab that is hidden from view when the carton is sealed.

Another object of the present invention is to provide a breakaway tab formed in an end flap forming the carton end such that upon severance of the breakaway tab, the end flap maintains substantially the same outer peripheral area.

Yet another object of the present invention is to provide a breakaway tab that is formed in only a portion of the thickness of an end flap forming a carton end.

In summary, the present invention discloses a novel design for a carton blank having a breakaway tab formed in each of the ends of the carton for eliminating gaps between the end flaps forming the carton ends thereby improving the seal and the overall appearance of the carton.

DETAILED DESCRIPTION OF THE INVENTION

Figure 1:
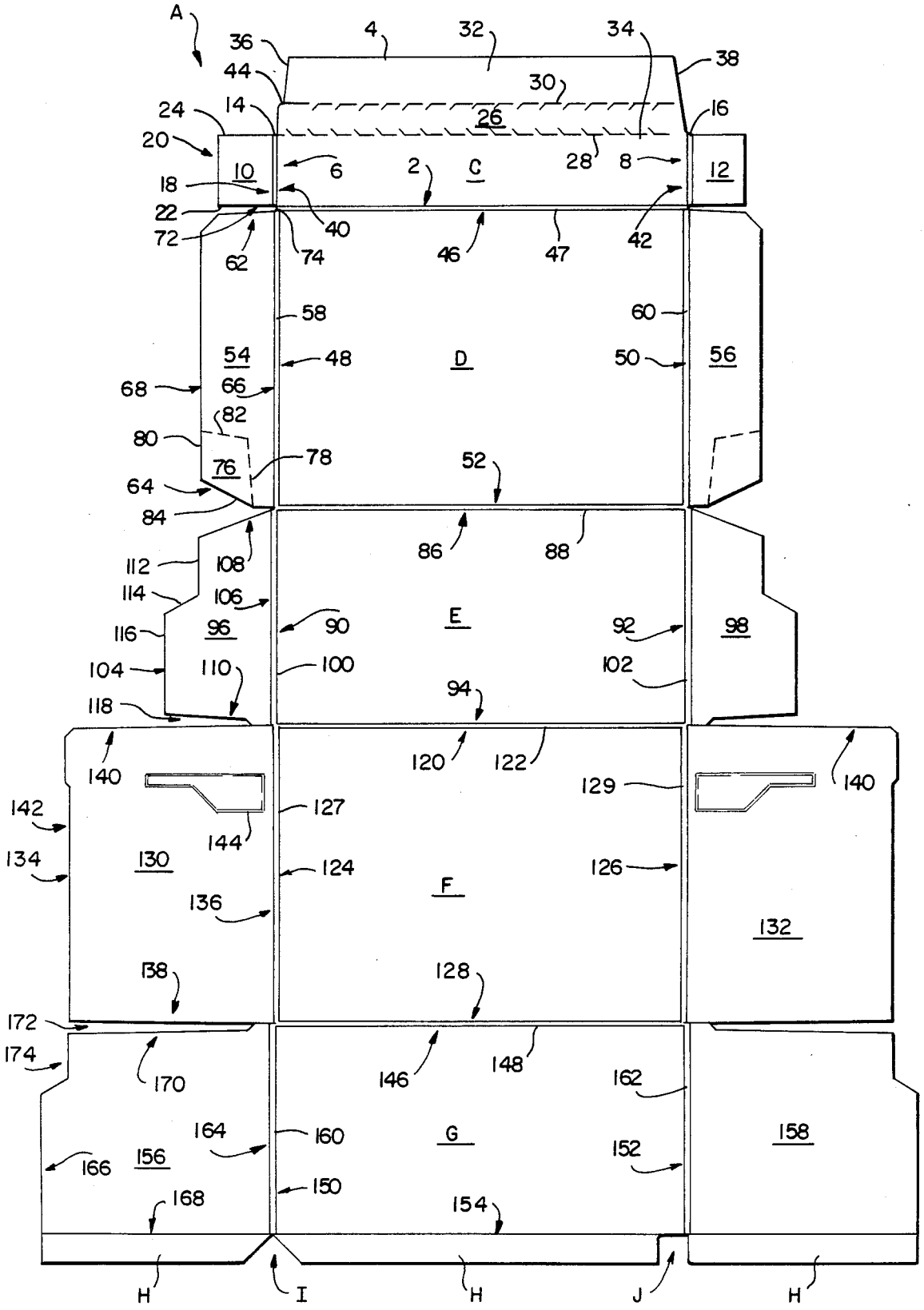
FIG. 1 is a plan view of the inner surface of a flat carton blank formed in accordance with the present invention.
Figure 2:
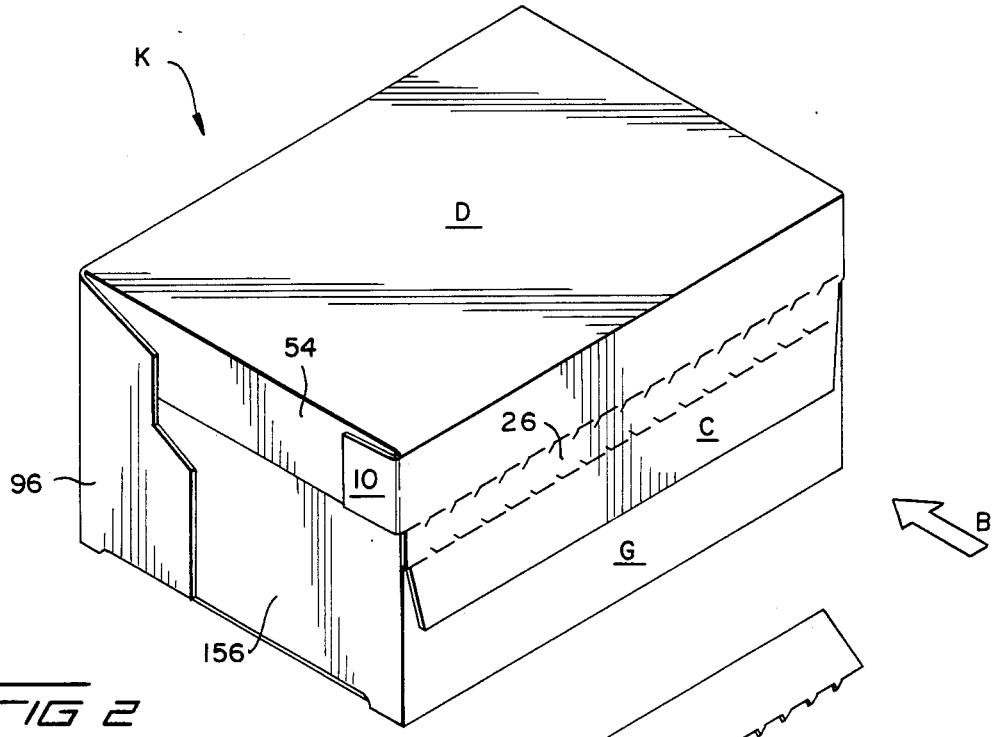
FIG. 2 is a perspective view of the sealed carton.
Figure 3:
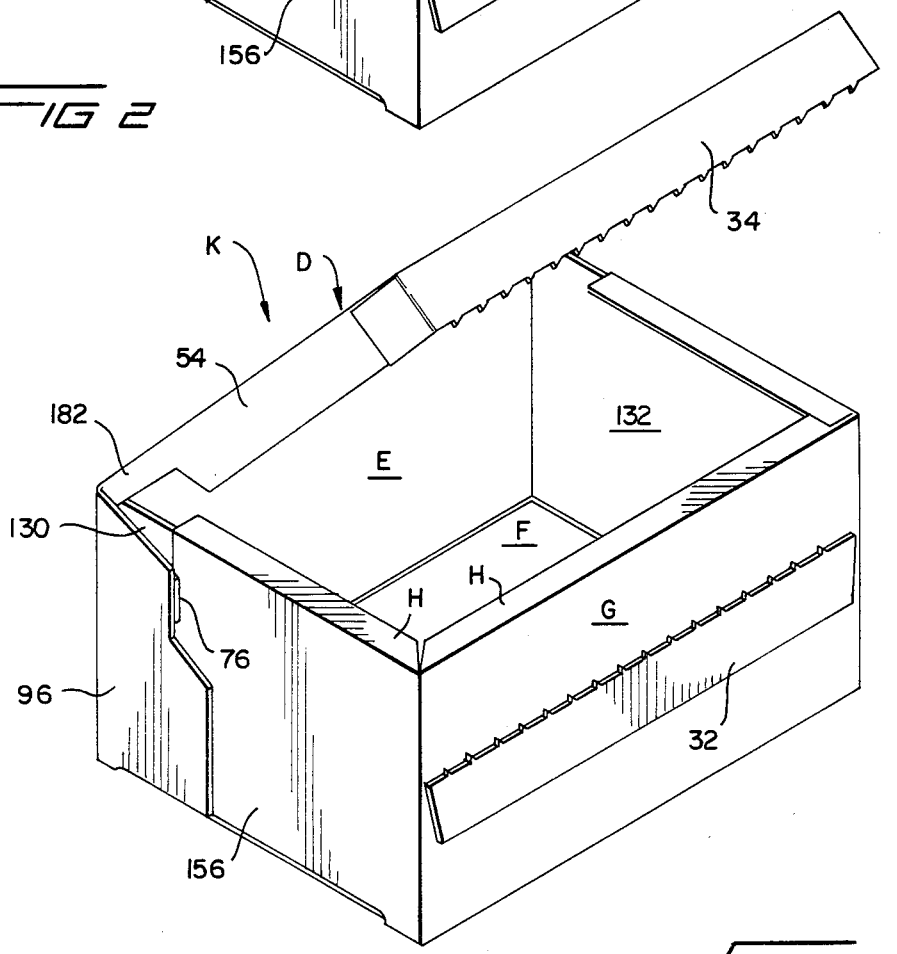
FIG. 3 is a perspective view of the carton formed in accordance with the present invention with the tear strip and breakaway tab removed from the cover panel.

Referring to FIG. 1, the specific nomenclature assigned to each component and subcomponent comprising carton blank A refers to its orientation when carton blank A is fully erected and as viewed in the direction of arrow B in FIG. 2. The carton blank A comprises a closure flap C, a cover panel D, a rear panel E, a bottom panel F and a front panel G. Closure flap C includes a top edge 2, a bottom edge 4, a left edge 6 and right edge 8. Left and right cover or glue tabs 10 and 12 are hingedly connected to left and right edges 6 and 8 respectively forming vertically extending hinge lines 14 and 16 therebetween. Cover tabs 10 and 12 include front edge 18, rear edge 20, top edge 22 and bottom edge 24. Top edges 22 extend substantially parallel to bottom edges 24. Further, rear edges 20 extend substantially parallel to and are joined to the corresponding hinge lines 14 and 16.

A tear strip 26 is formed in closure flap C. The tear strip 26 includes weakness lines 28 and 30 which subdivide closure flaps C into a glue panel 32 and a skirt or releasable flap 34. Glue panel 32 includes left and right ends 36 and 38 respectively. Skirt 34 includes left and right ends 40 and 42 respectively. Left and right ends 40 and 42 extend substantially parallel to corresponding hinge lines 14 and 16. Left end 36 of glue panel 32 is positioned inwardly from left end 40 of skirt 34 thereby permitting the consumer to readily access tab 44 of tear strip 26. Right end 38 of glue panel 32 forms an obtuse angle less than 180° with right end 42 of skirt 34. It will be readily appreciated that various types of tear tabs and tear strips may be used.

Cover panel D is hingedly connected at its front edge 46 to top edge 2 of closure flap C forming therebetween hinge line 47. Cover panel D further includes left edge 48, right edge 50, and rear edge 52. Left and right end flaps 54 and 56 are hingedly connected to left and right edges 48 and 50 respectively forming hinge lines 58 and 60 therebetween. Hinge lines 58 and 60 are offset inwardly from corresponding hinge lines 14 and 16.

Cover panel end flaps 54 and 56 includes front, rear, top and bottom edges 62, 64, 66 and 68 respectively. Front edges 62 are spaced from the corresponding top edges 22 of glue tabs 10 and 12 and form an acute angle with the corresponding hinge lines 58 and 60. Notches 72 are formed between glue tabs 10 and 12 and the associated cover panel end flaps 54 and 56. Notches or recesses 72 include an arcuate radius 74 formed adjacent hinge lines 58 and 60. Breakaway tabs 76 are formed adjacent rear edges 64 of cover panel end flaps 54 and 56. Breakaway tabs 76 are defined by perforation cuts or score line and include top, bottom, front and rear edges 78, 80, 82 and 84 respectively. The top edge 78 is spaced from top edge 66 of cover panel end flaps 54 and 56. The perforated cuts or score lines extend through the thickness of the blank A. Thus, the tear tabs 76 can be readily detached from the cover panel end flaps 54 and 56.

Rear panel E is hingedly connected at its top edge 86 to rear edge 52 of cover panel D forming therebetween hinge line 88. Rear panel E further includes left edge 90, right edge 92 and rear edge 94. Left and right rear panel end flaps 96 and 98 are hingedly connected to left and right edges 90 and 92 of rear panel E respectively. Vertically extending hinge lines 100 and 102 are formed between rear panel E and left and right rear panel end flaps 90 and 98. Hinge lines 100 and 102 are outwardly offset from corresponding hinge lines 58 and 60.

Rear panel end flaps 96 and 98 include front, rear, top and bottom edges 104, 106, 108 and 110 respectively. Front edges 104 form an acute angle with corresponding hinge lines 100 and 102. Top edges 104 include first, second and third sections 112, 114 and 116 respectively. First sections 112 form an obtuse angle less than 180° with front edges 108 and extend parallel to corresponding hinge lines 100 and 102. Second sections 114 extend angularly from first sections 112 and form an obtuse angle greater than 180° therewith. Third sections 116 extend parallel to corresponding hinge lines 100 and 102. Further, sections 116 form an obtuse angle of less than 180° with second sections 114. Bottom edges 110 have a cut out 118 formed therein.

Bottom panel F is hingedly connected at its top edge 120 to bottom edge 94 of rear panel E forming hinge line 122 therebetween. Bottom panel F further includes left edge 124, right edge 126, and front edge 128. End flaps 130 and 132 are hingedly connected to left and right edges 124 and 126 respectively forming hinge lines 127 and 129 therebetween. The hinge lines 127 and 129 are offset inwardly from the corresponding hinge lines 100 and 102. Left and right front panel end flaps 120 and 132 include top, bottom, front, and rear edges 134 136, 138 and 140 respectively. Cut-outs 142 are formed in top edges 134. Further, bottom panel end flaps 130 and 132 include an embossed portion 144 formed therein. The cut-outs 142 and embossed portions 144 are more fully described in copending patent application Ser. No. 07/021,649, the entire disclosure of which is hereby incorporated by reference. The widths of end flaps 130 and 132 are substantially equal to exterior width of bottom panel F.

The front panel G is hingedly connected at its bottom edge 146 to front edge 128 of bottom panel F forming hinge line 148. Front panel G further includes left edge 150, right edge 152 and top edge 154. End flaps 156 and 158 are hingedly connected to left and right edges 150 and 152 respectively. Hinge lines 160 and 162 are formed therebetween. Hinge line 160 and 162 are offset outwardly from corresponding hinge lines 127 and 129.

Front panel end flaps 156 and 158 include front, rear, top, and bottom edges 164, 166, 168 and 170 respectively. Bottom edges 170 each have a notch 172 formed therein. Notches 174 are formed in rear edges 166 of front panel end flaps 156 and 158. Notches 174 cooperate with embosssing sections 144 in the manner described in the aforementioned copending patent application. Membrane flaps H extend from top edges 168 of front panel end flaps 156 and 158 and top edge 154 of front panel G. Notches I and J are formed in membrane flaps H. The function of membrane flaps H and notches I and J are fully discussed in the aforementioned copending patent application.

CARTON ASSEMBLY

Figure 4:
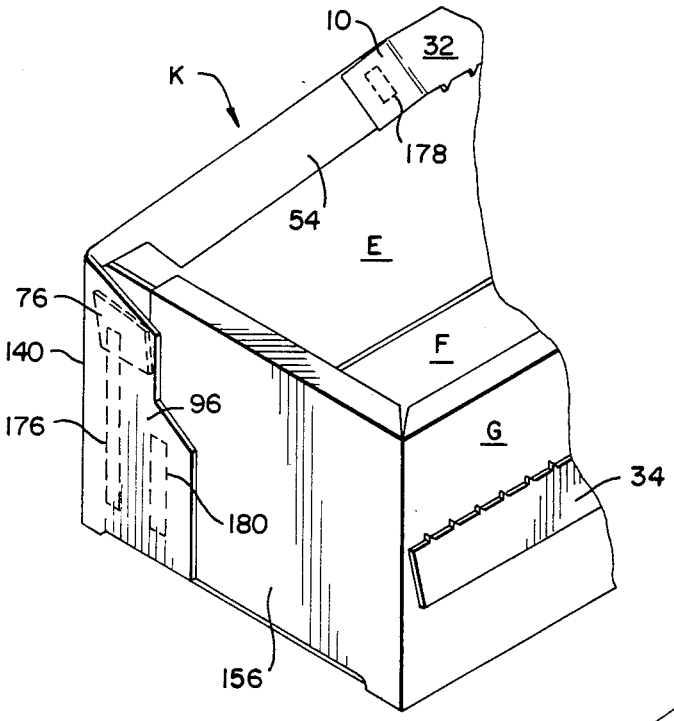
FIG. 4 is a fragmentary perspective view of the carton illustrated in FIG. 3 and further depicting the breakaway tab (shown in dotted lines) severed from the cover panel.

The steps taken to erect carton K, best seen in FIG. 2, will now be described. Front panel G is folded about hinge line 148 such that it overlays a portion of bottom panel end flap F. Subsequently, closure flap C and cover panel D are folded about hinge line 88 such that closure flap C overlaps front panel G and cover panel D overlaps rear panel E and bottom panel F. Pressure is applied to closure flap C to secure the same to front panel G. The blank A is then erected such that the front panel G, bottom panel F, rear panel E, and cover panel D form a substantially rectangular shaped carton with their corresponding end flaps extending in the same horizontal plane. The end flaps are then folded in the following sequence to form the sealed carton K. The folding steps will be described with reference to only the left end of carton K. However, the right end of the carton is formed in an identical manner. The bottom panel end flap 130 is folded in first. Subsequently, the front panel end flap 166 is folded in. The cover panel end flap 54 is then folded in such that it overlays front panel 156 and bottom panel 130. An adhesive is then applied to the carton end, more specifically, a single strip of adhesive 176, as best seen in FIG. 4, is applied vertically along the bottom panel end flap 130 adjacent its rear edge 140. The glue strip 176 is extended such that it is applied to the outer surface of breakaway tab 76 formed in cover panel end flap 54. A second glue strip 178 is applied to the cover panel end flap 54 adjacent front edge 62. The adhesive strips 176 and 178 can be applied either simultaneously or consecutively. Further, an additional glue strip 180 can be applied along the bottom panel end flap 130 spaced from adhesive strip 176. The glue strip 180 is extended to cover a portion of front panel end flap 156. Once the glue strips have been applied, the rear panel end flap 96 and the glue tab 10 are simultaneously folded inward to form a sealed carton end. The adhesive strip 176 secures the exterior surface of breakaway tab 76 to rear panel end flap 96. Alternatively, or in addition to the above mentioned glue patterns, the glue strip 176 can be extended along the bottom panel end flap 130 such that the inner surface (not shown) of breakaway tab 76 is secured to the bottom panel end flap 130.

CARTON OPENING AND RESEALING

Referring to FIG. 2, a consumer must remove tear strip 26 from closure flap C to gain access to the contents of carton K. Subsequently, the consumer will lift cover D in an upward direction from front panel G. As the cover D is lifted away from front panel G breakaway tabs 76 will severe from corresponding cover panel end flaps 54 and 56. The bottom panel end flaps 130 and 132 and the corresponding rear panel end flaps 96 and 98 form a pocket for receiving the corresponding cover panels 54 and 56 in order to reseal the carton K. The rear edges 106 and first sections 112 define the longitudinal boundaries of the pockets formed by end flaps 96 and 98 and the corresponding end flaps 130 and 132. It is important to note that the breakaway tabs are formed inward of top edges 66 of cover panel end flaps 54 and 56 such that a section 182 of cover panel end flaps 54 and 56 remains once the breakaway tabs 76 have been severed therefrom. Sections 182 are received in the pockets formed by the bottom panel end flaps 130 and 132 and the rear panel end flaps 96 and 98 for ensuring that the cover panel end flaps 54 and 56 remain in the folded position. Thus, once the carton K is resealed the end flaps 54 and 56 will resume their position prior to the opening of carton K.

The breakaway tabs 76 minimize the gaps between the end flaps of the carton K to enhance the overall seal of the carton. Further, by eliminating the gaps between end flaps forming the carton ends, a surface is formed which is significantly more desireable for displaying printed matter.

ALTERNATIVE EMBODIMENTS

Figure 5:
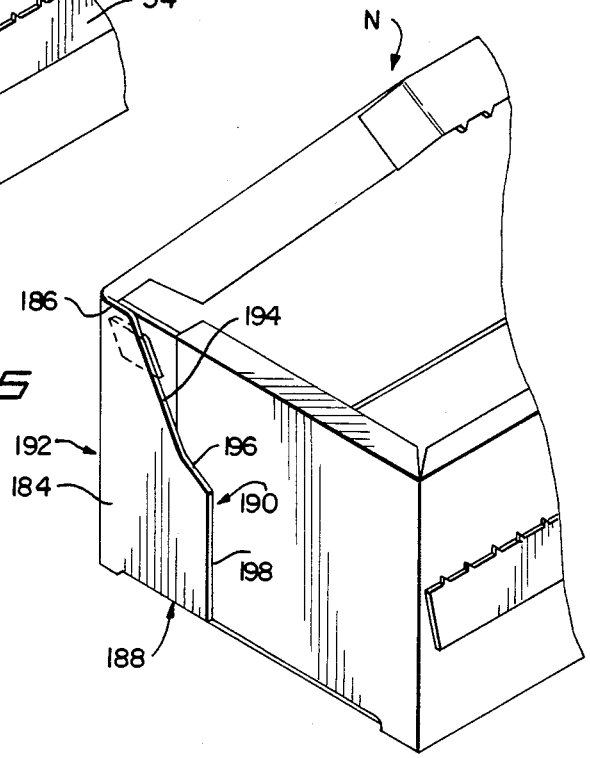
FIG. 5 is a fragmentary perspective view of a second embodiment formed in accordance with the present invention.

Referring to FIG. 5, the second embodiment of the present invention will now be described. The carton N depicted in FIG. 5, is identical to the carton K of FIG. 2 with the exception of rear panel end flaps 184 (only one is shown). The rear panel end flap 184 includes top edge 186, bottom edge 188, front edge 190, and rear edge 192. Bottom edge 188 and rear edge 192 are identical to bottom edges 110 and rear edges 106 of rear panel end flaps 96 and 98. Top edge 186 forms a right angle with rear edge 192. The front edge 190 of rear panel end flap 184 includes sections 194, 196, and 198. Section 194 forms an obtuse angle less than 180° with top edge 186. Section 196 forms an obtuse angle greater than 180° with first section 194. Section 198 forms an obtuse angle less than 180° with second section 196. Further, section 198 extends substantially parallel to rear edge 192. This particular configuration of rear panel end flap 184 improves the overall nesting of the blank A thereby minimizing the scrap material produced during the blanking operation.

Figure 6:
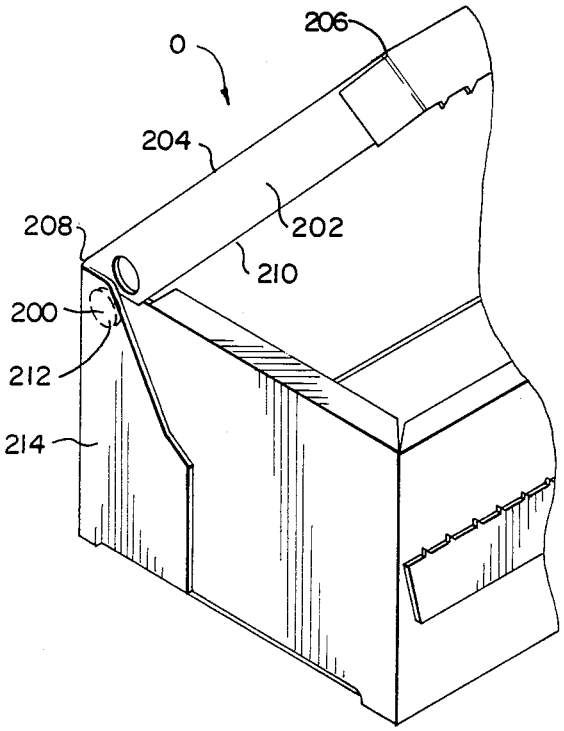
FIG. 6 is a fragmentary perspective view of a third embodiment formed in accordance with the present invention.

Referring to FIG. 6, the third embodiment of the present invention will now be described. The carton O depicted in FIG. 6 is identical to carton N, illustrated in FIG. 5, with the exception of breakaway tab 200. The breakaway tab 200 is formed in cover panel end flap 202. Cover panel end flap 202 includes top edge 204, front edge 206, rear edge 208 and bottom edge 210. The breakaway tab 200 is positioned inwardly of top edge 204, front edge 206, rear 208, and bottom edge 210. In positioning the breakaway tab 200 inwardly of all four edges of cover panel end flap 202, the outer perimeter of cover panel end flap 202 will remain in tacked and thus provide a tighter reseal for carton O. As can be readily seen from FIG. 6, the outer surface 212 of breakaway tab 200 is glued to rear panel end flap 214 so that upon opening of the carton O the breakaway tab 200 will severe from cover panel end flap 202.

Figure 7:
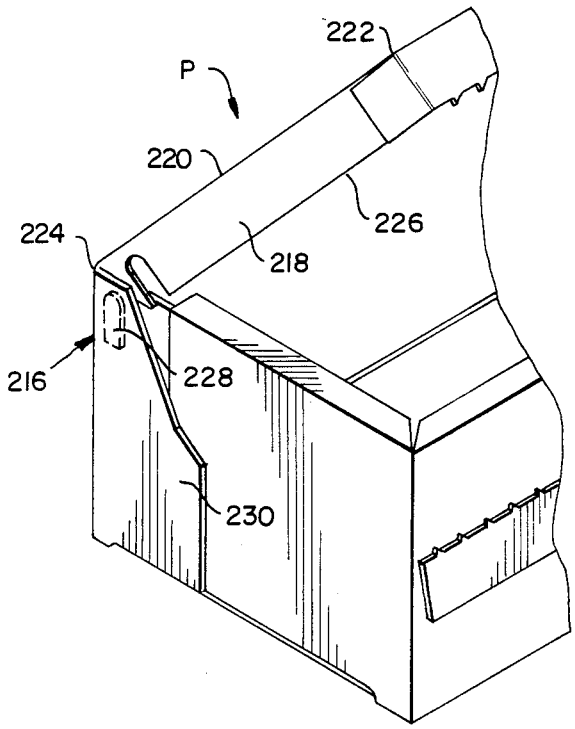
FIG. 7 is a fragmentary perspective view of a fourth embodiment formed in accordance with the present invention.

Referring to FIG. 7, the fourth embodiment of the present invention will now be described. The carton P, depicted in FIG. 7, is identical to the carton illustrated in FIG. 5 with the exception of breakaway tab 216. The breakaway tab 216 is substantially U-shaped and is formed in cover panel end flap 218. Cover panel end flap 218 includes top edge 220, front edge 222, rear edge 224 and bottom edge 226. Breakaway tabs 216 is positioned inwardly of top edge 220, front edge 222 and rear edge 224. As can be readily seen from FIG. 7, the breakaway tab 216 is secured to rear panel end flap 230 at outer surface 228. Thus, upon opening of the carton P, the breakaway tab 216 will severe from the cover panel end flap 218.

Figure 8:
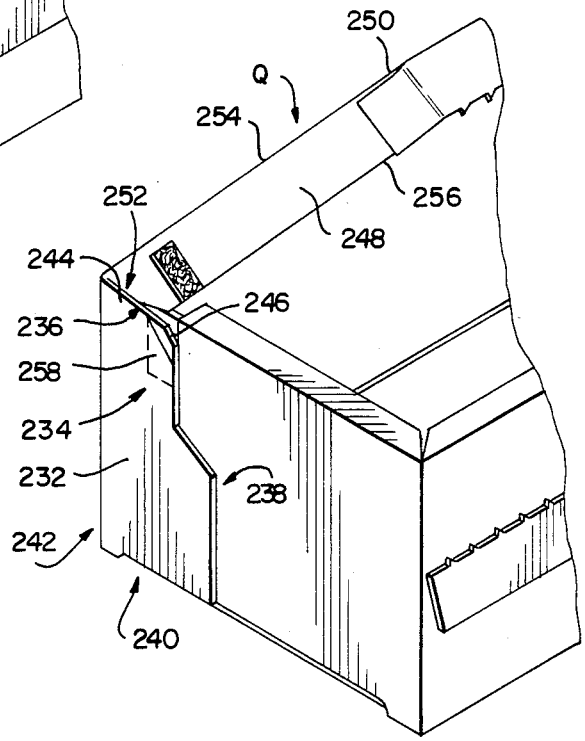
FIG. 8 is a fragmentary perspective view of a fifth embodiment of the present invention.

Referring to FIG. 8, the final embodiment of the present invention will now be described. The carton Q, illustrated in FIG. 8, is similar to the carton K depicted in FIG. 2. The differences lie in the rear panel end flap 232 and the breakaway tab 234. Rear panel end flap 232 includes top edge 236, front edge 238, bottom edge 240, and rear edge 242. The front edge 238, bottom edge 240, and rear edge 242 are substantially identical to the corresponding edges 104, 110, and 106 of rear panel end flaps 96 and 98 of carton K. The top edge 236 includes first section 244 and second section 246. First section 244 forms an acute angle with rear edge 242. Second section 246, at one end, forms an obtuse angle less than 180° with first section 244. At the other end, second section 246 forms an obtuse angle less than 180° with front edge 238.

Breakaway tab 234 is formed in cover panel end flap 248. Cover panel end flap 248 includes front, rear, top and bottom edges 250, 252, 254 and 256. The breakaway tab 234 extends through only a portion of cover panel end flap 248. Thus, unlike the previous embodiments, the notch formed upon severing of the breakaway tab 234 does not extend through the cover panel end flap 248. This feature ensures a tighter reseal of carton Q once the tear strip (not shown) has been removed.

In this embodiment, the adhesive strip used to secure the breakaway tab 234 to the carton end must be applied to the outer surface 258 of the breakaway tab 234.

The method for erecting the aforementioned alternative embodiments is identical to that of carton K.

While this invention has been described as having preferred design, it is understood that it is capable of further modification, uses and/or adaption of the invention following in general the principle of the invention including such departure from the present disclosure as come within the known or customary practice in the art to which the invention pertains, and as may be applied to the central features set forth and fall within the scope of the invention and of the limits of the appended claims.

What we claim is:

1. A carton for packaging ice cream and the like, comprising:

(a) a receptacle, including operably connected front bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover further including a closure flap;

(h) said cover panel being operably connected at its rear edge to said top edge of said rear panel;

(i) means for securing said closure flap to said front panel;

(j) said receptacle further including left and right end flaps operably connected to said left and right edges of each of said front, bottom and rear panels respectively;

(k) said cover further including left and right end flaps operably connected to said left and right edges of said cover panel respectively;

(l) said right end flaps of said receptacle and said cover being dimensioned to form a substantially sealed right end of said carton;

(m) said left end flaps of said receptacle and said cover being dimensioned to form a substantially sealed left end of said carton;

(n) at least one of said left and right ends of said carton having pocket means including an opening for receiving at least a portion of its respective cover panel end flap subsequent to initial opening thereof;

(o) said end flaps each having top, bottom, front and rear edges;

(p) breakaway tab means being formed in at least one of said end flaps of said at least one of said left and right sealed ends of said carton having said pocket means;

(q) said breakaway tab means including first and second surfaces;

(r) said cover and said receptacle each having attachment areas;

(s) said first surface of said breakaway tab means being detachably connected to one of said attachment areas, said second surface of said breakaway tab means being fixed to the other of said attachment areas;

(t) a glue line extending on one of said left and right bottom panel end flaps adjacent the rear edge of its respective front panel end flap;

(u) said glue line extending from about the bottom edge of said one of said left and right bottom panel end flaps and beyond and onto the breakaway tab means at the lower edge of its respective cover panel end flap such that a substantial portion of said one of said left and right bottom panel end flaps and a substantial edge portion of said respective cover panel end flap between said breakaway tab means and the rear edge of said respective cover panel end flap each lies on one side of said glue line;

(v) said pocket means being formed between said substantial portion of said one of said left and right bottom panel end flaps and a corresponding portion of its respective rear panel end flap;

(w) said substantial edge portion of said respective cover panel end flap underlying a corresponding edge portion of its respective rear panel end flap;

(x) said edge portions of said respective cover panel end flap and said rear panel end flap being spaced from said glue line;

(y) said substantial edge portion of said respective cover panel end flap being positioned in said pocket means opening and extending therein; and (z) said bottom panel end flap being the first-in end flap, said front panel end flap being the second-in end flap, said cover panel end flap being the third-in end flap, and said rear panel end flap being the fourth-in end flap, respectively, of one of said left and right ends of said carton.

2. A carton as in claim 1, wherein:

(a) said left and right ends of carton each have pocket means; and (b) said pocket means are formed such that said portions of said rear panel end flaps form an exterior portion of said pocket means and are operably associated with its corresponding bottom panel end flap portion forming an interior portion of said pocket means.

3. A carton as in claim 1, wherein:

(a) said breakaway tab means is formed in one of said cover panel end flaps and said rear panel end flaps.

4. A carton as in claim 3, wherein:

(a) said breakaway tab means is formed in said cover panel end flaps.

5. A carton as in claim 4, wherein:

(a) said breakaway tab means is positioned adjacent said rear panel of said receptacle.

6. A carton as in claim 1 wherein:

(a) at least a portion of said breakaway tab means is positioned in said opening of said pocket means.

7. A carton for packaging ice cream and the like comprising:

(a) a receptacle having an opening formed therein for receiving semi-liquids or liquids;

(b) a cover operably connected to said receptacle for forming a substantially sealed carton;

(c) said carton includes first and second substantially sealed carton ends;

(d) at least one of said first and second ends of said carton including pocket means having an opening for receiving at least a respective portion of said cover subsequent to initial opening thereof;

(e) breakaway tab means having first and second surfaces, said breakaway tab means being formed in said at least one of said first and second substantially sealed ends of said carton having said pocket means;

(f) said cover and said receptacle each having attachment areas;

(g) said first surface of said breakaway tab means being detachably connected to one of said attachment areas, said second surface of said breakaway tab means being fixed to the other of said attachment areas;

(h) said opening of said pocket means having first and second side walls;

(i) at least a portion of said breakaway tab means being positioned in said pocket means opening and extending therein;

(j) said cover comprising a cover panel including left and right end flaps;

(k) said left and right end flaps of said cover panel each including a plurality of peripheral edges;

(l) said breakaway tab means is formed in at least one of said left and right cover panel end flaps; and (m) said breakaway tab means is spaced inwardly from at least three of said peripheral edges of said at least one of said left and right cover panel end flaps.

8. A carton as in claim 7, wherein:

(a) said breakaway tab means is detachably connected at said first surface to said cover and fixed at said second surface to said receptacle.

9. A carton as in claim 7, wherein:

(a) said receptacle includes operably connected front, bottom, and rear panels;

(b) said front panel and said rear panels each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel; and (f) said receptacle further including left and right end flaps operably connected to said left and right edges of each of said panels of said receptacle respectively.

10. A carton as in claim 9, wherein:

(a) said cover panel having front, rear, left and right edges;

(b) said cover panel being operably connected at its rear edge to said top edge of said rear panel of said receptacle; and (c) said cover panel left and right end flaps operably connected to said left and right edges of said cover panel respectively.

11. A carton as in claim 9, wherein:

(a) said pocket means are formed in each of said left and right ends of said carton, and (b) said pocket means are formed such that said rear panel end flaps form an exterior portion of said pocket means and are operably associated with at least one other corresponding end flaps of said receptacle forming an interior portion of said pocket means.

12. A carton a in claim 10, wherein:

(a) said breakaway tab means is formed in each of said left and right cover panel end flaps.

13. A carton as in claim 12, wherein:

(a) said breakaway tab means are spaced inwardly from said peripheral edges of said left and right cover panel end flaps.

14. A carton as in claim 9, wherein:

(a) said breakaway tab means being formed in said at least one of said cover panel end flaps of said at least one of said left and right sealed ends of said carton having said pocket means; and (b) said breakaway tab means extends through only a portion of the thickness of said at least one of said cover panel end flaps of said at least one of said left and right sealed ends of said carton having said pocket means.

15. A carton for packaging ice cream or the like, comprising:

(a) a receptacle, including operably connected front, bottom and rear panels;

(b) said front and rear panels each having top, bottom, left and rear panels;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover panel being operably connected at its rear edge to said top edge of said rear panel of said receptacle;

(h) said cover further including a closure flap operably connected to said front edge of said cover panel;

(i) means for securing said closure flap to said front panel;

(j) said panels of said receptacle and said cover each having left and right end flaps connected to said left and right edges respectively, and said end flaps each having top, bottom, front and rear edges;

(k) said left end flaps of said receptacle and said cover being dimensioned to form a substantially sealed left end of said carton;

(l) said right end flaps of said receptacle and said cover being dimensioned to form a substantially sealed right end of said carton;

(m) at least one of said left and right sealed ends having pocket means including an opening for receiving a portion of said cover panel subsequent to initial removal of said closure flap from said front panel;

(n) said pocket means includes said rear panel end flap of said at least one of said left and right sealed ends having said pocket means forming an exterior portion of said pocket means and being operably associated with at least one other end flap of said receptacle forming an interior portion of said pocket means;

(o) at least one of said end flaps of said at least one of said left and right sealed ends having said pocket means including breakaway tab means having first and second surfaces;

(p) said first surface of said breakaway tab means being detachably connected to one of said cover and said receptacle;

(q) said second surface being fixed to the other of said cover and said receptacle, whereby upon initial opining of said carton said breakaway tab means is severed from one of said receptacle and said cover;

(r) said breakaway tab means extends through only a portion of the thickness of said at least one of said end flaps of said at least one of said left and right sealed ends having said pocket means; and (s) said bottom panel end flap being the first-in end flap, said front panel end flap being the second-in end flap, said cover panel end flap being the third-in end flap, and said rear panel end flap being the fourth-in end flap, respectively, of one of said left and right ends of said carton.

16. A carton as in claim 15, wherein:

(a) said breakaway tab means are formed in each of said left and right cover panel end flaps.

17. A carton as in claim 16, wherein:

(a) said breakaway tab means are formed adjacent said rear panel.

18. A carton as in claim 15, wherein:

(a) said breakaway tab means is spaced inwardly from at least three said edges of said at least one of said end flaps of said at least one of said left and right sealed ends having said pocket means.

19. A carton as in claim 15, wherein:

(a) at least a portion of said breakaway tab means extends in said opening of said pocket means.

20. A carton for packaging ice cream or the like, comprising:

(a) a receptacle, including operably connected front, bottom and rear panels;

(b) said front panel and rear panels each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover panel being operably connected at its rear edge to said top edge of said to edge of said rear panel of said receptacle;

(h) said cover further including a closure flap operably connected to said front edge of said cover panel;

(i) means for securing said closure flap to said front panel;

(j) said panels of said receptacle and said cover each having left and right end flaps connected to said left and right edges respectively; said end flaps each having top, bottom, front and rear edges;

(k) said left end flaps of said receptacle and said cover being dimensioned to form a substantially sealed left end of said carton;

(l) said right end flaps of said receptacle and said cover being dimensioned to form a substantially sealed right end of said carton;

(m) at least one of said end flaps of said receptacle and said cover having a breakaway tab means including first and second surfaces;

(n) said first surface of said breakaway tab means being detachably connected to one of said at least one of said end flaps of said receptacle and said cover;

(o) said second surface of said breakaway tab means being fixed to the other of said at least one of said end flaps of said receptacle and said cover in order that said breakaway tab means is readily severed from said at least one of said end flaps of said receptacle and cover upon initial opening of said carton; and (p) said breakaway tab means extending through only a portion of the thickness of said at least one of said end flaps of said receptacle and cover.

21. A carton as in claim 20, wherein:

(a) said breakaway tab means is substantially rectangular in shape.

22. A carton as in claim 20, wherein:

(a) said breakaway tab means is formed in each of said left and right cover panel end flaps.

23. A carton as in claim 22, wherein:

(a) said breakaway tab means are spaced inwardly from at least any three edges of said left and right cover panel end flaps.

24. A carton as in claim 23, wherein:

(a) at least one of said left and right ends of said carton includes pocket means for receiving its respective cover panel end flap subsequent to initial opening thereof; and (b) said pocket means is formed such that said rear panel end flap of at least one of said left and right ends of said carton forms an exterior portion of said pocket means and is operably associated with at least one other end flap of said at least one of said left and right ends of said carton forming an interior portion of said pocket means.

25. A carton for packaging ice cream or the like, comprising:

(a) a receptacle, including operably connected front, bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) said rear panel being operably connected at its bottom edge to said rear edge of said bottom panel;

(g) a cover including a cover panel having front, rear, left and right edges;

(h) said cover panel being operably associated at its rear edge to said top edge of said rear panel of said receptacle;

(i) said cover panel further including a closure flap operably connected to said front edge of said cover panel;

(j) means for securing said closure flap to said front panel;

(k) said panels of said receptacle and said cover each having left and right end flaps connected to said left and right edges respectively, said end flaps each having top, bottom, front and rear edges;

(l) said left end flaps of said receptacle and said cover being dimensioned to form a substantially sealed left end of said carton;

(m) said right end flaps of said receptacle and said cover being dimensioned to form a substantially sealed right end of said carton;

(n) at least one of said end flaps of one of said receptacle and said cover having a breakaway tab means;

(o) said breakaway tab means including first and second surfaces, said first surface being detachably connected to one of said cover and said receptacle, said second surface being fixed to the other of said receptacle and said cover, wherein upon opening of said carton said breakaway tab means is severed from one of said cover and said receptacle;

(p) said breakaway tab means being spaced inwardly from at least any three of said edges of said at least one of said end flaps of one of said receptacle and said cover; and (q) said bottom panel end flap being the first-in end flap, said front panel end flap being the second-in end flap, said cover panel end flap being the third-in end flap, and said rear panel end flap being the fourth-in end flap, respectively, of one of said left and right ends of said carton.

26. A carton as in claim 25, wherein:

(a) said breakaway tab means is substantially U-shaped.

27. A carton as in claim 25, wherein:

(a) said breakaway tab means is spaced inwardly from said top, bottom, front and rear edges of said at least one of said end flaps of one of said receptacle and said cover.

28. A carton as in claim 27, wherein:

(a) said breakaway tab means is substantially circular in shape.

29. A carton as in claim 25, wherein:

(a) at least one of said left and right ends of said carton include pocket means for receiving its respective cover panel end flap subsequent to initial opening of said carton;

(b) said pocket means is formed such that said rear panel end flap of said at least one of said left and right ends of said carton forms an exterior portion of said pocket means and is operably associated with at least one other end flap of said at least one of said left and right ends of said carton forming an interior portion of said pocket means.

30. A carton for packaging ice cream and the like, comprising:

(a) a receptacle, including operably connected front bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover further including a closure flap;

(h) said cover panel being operably connected at its rear edge to said top edge of said rear panel;

(i) means for securing said closure flap to said front panel;

(j) said receptacle further including left and right end flaps operably connected to said left and right edges of each of said front, bottom and rear panels respectively;

(k) said cover further including left and right end flaps operably connected to said left and right edges of said cover panel respectively;

(l) said right end flaps of said receptacle and said cover being dimensioned to form a substantially sealed right end of said carton;

(m) said left end flaps of said receptacle and said cover being dimensioned to form a substantially sealed left end of said carton;

(n) at least one of said left and right ends of said carton having pocket means for receiving at least a portion of its respective cover panel end flap subsequent to initial opening thereof;

(o) said end flaps each having top, bottom, front and rear edges;

(p) breakaway tab means being formed in at least one of said end flaps of said at least one of said left and right sealed ends of said carton having said pocket means;

(q) said breakaway tab means including first and second surfaces;

(r) said cover and said receptacle each having attachment areas;

(s) said first surface of said breakaway tab means being detachably connected to one of said attachment areas, said second surface of said breakaway tab means being fixed to the other of said attachment areas;

(t) said pocket means being formed between one of said bottom panel end flaps and its corresponding rear panel end flap;

(u) said breakaway tab means is spaced inwardly from any two of said edges of said at least one of said end flaps of said at least one of said left and right sealed ends of said carton having said pocket means; and (v) said breakaway tab means extending through only a portion of the thickness of said at least one of said end flaps of said at least one of said left and right sealed ends of said carton having said pocket means.

31. A carton for packaging ice cream and the like, comprising:

(a) a receptacle, including operably connected front bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover further including a closure flap;

(h) said cover panel being operably connected at its rear edge to said top edge of said rear panel;

(i) means for securing said closure flap to said front panel;

(j) said receptacle further including left and right end flaps operably connected to said left and right edges of each of said front, bottom and rear panels respectively;

(k) said cover further including left and right end flaps operably connected to said left and right edges of said cover panel respectively;

(l) said right end flaps of said receptacle and said cover being dimensioned to form a substantially sealed right end of said carton;

(m) said left end flaps of said receptacle and said cover being dimensioned to form a substantially sealed left end of said carton;

(n) at least one of said left and right ends of said carton having pocket means for receiving at least a portion of its respective cover panel end flap subsequent to initial opening thereof;

(o) said end flaps each having top, bottom, front and rear edges;

(p) breakaway tab means being formed in at least one of said end flaps of said at least one of said left and right sealed ends of said carton having said pocket means;

(q) said breakaway tab means including first and second surfaces;

(r) said cover and said receptacle each having attachment areas;

(s) said first surface of said breakaway tab means being detachably connected to one of said attachment areas, said second surface of said breakaway tab means being fixed to the other of said attachment areas;

(t) said pocket means being formed between one of said bottom panel end flaps and its corresponding rear panel end flap; and (u) said breakaway tab means is spaced inwardly from at least three of said edges of said at least one of said end flaps of said at least one of said left and right sealed ends of said carton having said pocket means.

32. A carton for packaging ice cream and the like, comprising:

(a) a receptacle, including operably connected front bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover further including a closure flap;

(h) said cover panel being operably connected at its rear edge to said top edge of said rear panel;

(i) means for securing said closure flap to said front panel;

(j) said receptacle further including left and right end flaps operably connected to said left and right edges of each of said front, bottom and rear panels respectively;

(k) said cover further including left and right end flaps operably connected to said left and right edges of said cover panel respectively;

(l) said right end flaps of said receptacle and said cover being dimensioned to form a substantially sealed right end of said carton;

(m) said left end flaps of said receptacle and said cover being dimensioned to form a substantially sealed left end of said carton;

(n) at least one of said left and right ends of said carton having pocket means for receiving at least a portion of its respective cover panel end flap subsequent to initial opening thereof;

(o) breakaway tab means being formed in at least one of said end flaps of said at least one of said left and right sealed ends of said carton having said pocket means;

(p) said breakaway tab means including first and second surfaces;

(q) said cover and said receptacle each having attachment areas;

(r) said first surface of said breakaway tab means being detachably connected to one of said attachment areas, said second surface of said breakaway tab means being fixed to the other of said attachment areas;

(s) said pocket means being formed between one of said bottom panel end flaps and its corresponding rear panel end flap;

(t) said breakaway tab means extending through only a portion of the thickness of said at least one of said end flaps of said at least one of said left and right sealed ends of said carton having said pocket means.

* * * * *

UNITED STATES PATENT AND TRADEMARK OFFICE

CERTIFICATE OF CORRECTION

PATENT NO. : 4,757,902

DATED : July 19, 1988

INVENTOR(S) : Jack E. Hutchinson; Paul J. Donohie; Richard E. DePaul; Frank G. Capuano; Robert J. McCormick It is certified that error appears in the above-identified patent and that said Letters Patent is hereby corrected as shown below: Title page item [75]

Inventor(s): Jack E. Hutchinson, Rochester;
Paul J. Donohie, Pittsford, both of N.Y.;
Richard E. DePaul, Williamsburg, Va.;
Frank G. Capuano; Robert J. McCormick,
both of Rochester, N.Y.

Signed and Sealed this

Eighth Day of November, 1988

*Attest:*

DONALD J. QUIGG

*Attesting Officer*

*Commissioner of Patents and Trademarks*